US005560328A

United States Patent [19]

Bell et al.

[11] Patent Number: 5,560,328

[45] Date of Patent: Oct. 1, 1996

[54] INDUCTION SYSTEM OF INTERNAL COMBUSTION ENGINES

[75] Inventors: Gregory B. Bell, Woodlands; Heiner Louis, Hillarys, both of Australia

[73] Assignee: Orbital Engine Company Pty. Limited, Western Autralia, Australia

[21] Appl. No.: 530,375

[22] PCT Filed: May 10, 1994

[86] PCT No.: PCT/AU94/00240

§ 371 Date: Oct. 13, 1995

§ 102(e) Date: Oct. 13, 1995

[87] PCT Pub. No.: WO94/27037

PCT Pub. Date: Nov. 24, 1994

[30] Foreign Application Priority Data

May 14, 1993 [AU] Australia ..... PL8804

[51] Int. Cl.[6] ..... F02F 1/22; F02F 1/14; F02M 35/10

[52] U.S. Cl. ..... 123/73 R; 123/195 R; 123/73 PP

[58] Field of Search ..... 123/73 R, 73 PP, 123/195 R

[56] References Cited

U.S. PATENT DOCUMENTS

| | | | |
|---|---|---|---|
| 3,530,841 | 9/1970 | Brookfield | 123/73 R |
| 3,815,558 | 6/1974 | Tenney | 123/73 R |
| 4,190,023 | 2/1980 | Fujikawa et al. | 123/41.72 |
| 4,242,993 | 1/1981 | Onishi | 123/73 R |
| 4,530,313 | 7/1985 | Feichtinger | 123/41.74 |
| 4,879,974 | 11/1989 | Alvers | 123/73 PP |

FOREIGN PATENT DOCUMENTS

3343420A1 7/1984 Germany .

OTHER PUBLICATIONS

Patent Abstracts of Japan, M-1516, p. 138, JP,A, 5-202802.

*Primary Examiner*—Marguerite McMahon
*Attorney, Agent, or Firm*—Nikaido, Marmelstein, Murray & Oram LLP

[57] ABSTRACT

A multi-cylinder reciprocating piston internal combustion engine, preferably operating on the two-stroke cycle, having a cylinder block 8 incorporating a bank of cylinders 10 each communicating with a crankcase 15. Each cylinder having inlet ports 20,21,22,29,30 located on each of the two opposite sides of the bank of cylinders 10, and a conduit 17 communicating at least one port on one side of the bank with at least one port on the opposite side of the bank. That conduit 17 extends through a crankshaft bearing support portion 14*a* of the cylinder block 8 located within said crankcase 15 below the level of the cylinders 10. There is preferably one bearing support portion 14*a* within the crankcase 15 and below the junction between each two adjacent cylinders 10, with a respective conduit 17 extending through said bearing support portion 14*a*.

11 Claims, 3 Drawing Sheets

INDUCTION SYSTEM OF INTERNAL COMBUSTION ENGINES

This invention relates to the construction of the cylinder block and/or crankcase of a multi-cylinder internal combustion engine and particularly relates to the provision of appropriate passageways therein for the distribution of gas to or from respective cylinders of the engine at multiple locations. The present invention will be described in relation to the provision of appropriate passageways in the cylinder block and/or crankcase of a two-stroke multi-cylinder internal combustion engine to facilitate the distribution of incoming air from one side of a cylinder bank of the engine to the other. It is however to be appreciated that the invention is not limited to this application, and that other applications are also envisaged for both two and four stroke engines.

It is well appreciated particularly in the automotive engine industry that it is most important to miniraise engine size and weight as these lead directly to weight and space savings in the vehicle body, suspension and other areas. Such engine size and weight minimisations are also of benefit in other engine applications such as in marine and motorcycle applications, particularly with regard to the packaging and overall weight of the engine.

In order to obtain the desired gas flow within the cylinder of an engine to achieve the required power output, fuel efficiency, and exhaust gas emission control, the disposition of the exhaust port(s) and inlet or transfer port(s) is a critical factor. This is particularly so in an engine operating on the two-stroke cycle.

It is a common feature of engines operating on the two-stroke cycle that the transfer port(s) and the exhaust port(s) are open at the same time in the engine combustion cycle during at least part of the cycle. Accordingly, there is a potential for part of the fresh air charge entering the cylinder through the transfer port(s) to travel across the cylinder and escape through the exhaust port(s) during this period (commonly referred to as "short circuiting"). Modern two-stroke cycle engines normally use a configuration of transfer ports that establish a generally upwardly directed flow of the incoming fresh air charge within the engine cylinder which is then deflected downward by the cylinder head toward the exhaust port(s).

Such engines are generally referred to as loop-scavenged engines and in a typical modern example the cylinder has main transfer ports on either side of the exhaust port arranged to direct the incoming fresh air charge away from the exhaust port and towards the opposite side of the cylinder and auxiliary transfer port(s) located generally opposite the exhaust port. The combined effect of the auxiliary and main transfer ports is to create an upward flow of the incoming fresh air charge on the side of the cylinder opposite to the exhaust port, thereby avoiding short circuiting of the incoming charge to the exhaust port.

Although the above described transfer port arrangement is desirable to achieve effective scavenging of exhaust gases from the cylinder and the correct location of the fresh air charge within the cylinder, the necessity to provide transfer ports on the opposite sides of the cylinder presents a challenge in applying the loop scavenge configuration to a multi-cylinder in-line engine whilst minimising engine size and weight. One solution would be to provide passages from one side of the engine to the other side thereof located between the cylinder bores. This however would lead to a substantial increase in engine block length. This increase in engine block length typically results in a corresponding increase in engine weight, and in automotive applications, an increase in engine compartment size and hence overall vehicle size and weight.

Several prior art constructions to achieve air distribution from one side of an engine to the other are known and result from various different engine requirements and limitations. One such prior art construction is to duct air over the top of the engine, however this invariably leads to an increase in the overall height of the engine and is complicated by the presence and necessary location of other engine components above the cylinder head.

An alternative construction is to provide air passages through the cylinder head from one side of the engine to the other, but this typically would seriously interfere with the cooling passages in the cylinder head and hence the overall effective cooling of the engine. Also, space is required in the cylinder head for installation of such components as spark plugs and fuel injector nozzles. Similarly, the provision of a passage around one or both ends of the cylinder block would result in an increase in the overall engine length, and can also interfere with the mountings for components such as the water pump and drive pulleys for auxiliary equipment such as an alternator, water pump and compressor.

It is an object of the present invention to provide an improved arrangement of at least one conduit means which avoids adding additional length, height and weight to the engine.

With this object in view, there is provided according to the present invention, a reciprocating piston internal combustion engine having at least one cylinder, including a conduit means extending through a section of the engine located below the at least one cylinder, the conduit means providing communication between opposite sides of the or each cylinder. The engine preferably has at least two cylinders, the conduit means being located below the junction of the or each of the adjacent cylinders.

In one preferred arrangement, the or each cylinder has at least one port on one side thereof, the conduit means providing communication between the or each port and an opposite side of the or each cylinder. The conduit means may provide communication between the or each port located on one side of the or each cylinder, and an opposing at least one port located at an opposite side of the or each cylinder. The conduit means preferably enables the transfer of gases associated with the combustion process within the or each cylinder. The gas may be air, and the or each port may be an inlet port for supplying air to the or each cylinder. It is also envisaged that exhaust gases may be transferred to and from the or each cylinder by the conduit means.

The conduit means may be arranged to communicate with ports in two adjacent cylinders. In this arrangement, the ports in two adjacent cylinders may be arranged so that only one is open at any one time.

Where the engine is of the externally scavenged construction, that is, with air supplied from a pressurised source external to the engine such as by a blower or compressor, a crankcase of the engine can define a single cavity at the lower end of all cylinders in a bank or banks of the engine. In such a construction, the or each port on one side of the or each cylinder may communicate with a first common gallery, the or each port on the opposing side of the or each cylinder preferably communicating with a second common gallery, the conduit means extending between said common galleries to provide communication therebetween. This is also relevant in an arrangement where the engine comprises individual crankcase compartments per cylinder.

The conduit means preferably extends through an at least one crankshaft bearing support located within a crankcase of the engine. In the engine including a cylinder block having a plurality of cylinders and providing a portion of the at least one said crankshaft bearing support, the or each bearing support portion may be located below the junction of the or each of the adjacent cylinders, with a part of said conduit means preferably extending through the or each said bearing support portion. The conduit means may extend through the crankshaft bearing support portion above a crankshaft supported by the bearing support. Alternatively, the conduit means may extend through the crankshaft support portion beneath a crankshaft supported by the bearing support.

It is also envisaged that the conduit means may enable the transfer of liquid between the opposite sides of the or each cylinder, the liquid preferably being a coolant, such as water, used for cooling of the engine.

The above described engine may be a two stroke engine, although it is also envisaged that the engine be of the four stroke type. The engine can be of a form having a single bank of cylinders each arranged with the axes thereof in a common longitudinal plane, or the engine can have two or more banks of cylinders, each bank having a plurality of cylinders arranged with the axes thereof in a respective common longitudinal plane, such as in the known V configuration of cylinders in a multi-cylinder engine. When the invention is applied to an engine with the V configuration of cylinder banks, the two banks of cylinders can conveniently be arranged with a common crankcase, and preferably with the conduit means communicating with ports in each bank of cylinders.

The above proposed constructions enable the conduit means conveying gas to or from ports on opposite sides of the cylinder bank of the engine, to pass through the engine crankcase below the lower extremity of the cylinders thereby permitting the cylinders to be located so the centre distance between adjacent cylinders can be reduced to not substantially more than the total of the required wall thickness of the two adjacent cylinders. Further, by incorporating the portion of the conduit means that passes through the crankcase within the bearing support, the size of the crankcase is not significantly enlarged to accommodate the conduit. As a result of this construction, the length and height of the engine block is not substantially increased as a result of the provision of the conduit to supply gas to or from ports on either side of a cylinder bank of the block.

Terms such as "lower", "upper", "below" and "above" relate to the orientation of the engine when the axis of the cylinders of one bank are substantially vertical. However, other engine orientations are also possible and the use of these terms is not intended to limit the scope of the invention.

The invention will be more readily understood from the following description of one practical arrangement of a multi-cylinder engine incorporating the invention, and as illustrated in the accompanying drawings.

Figure 1:
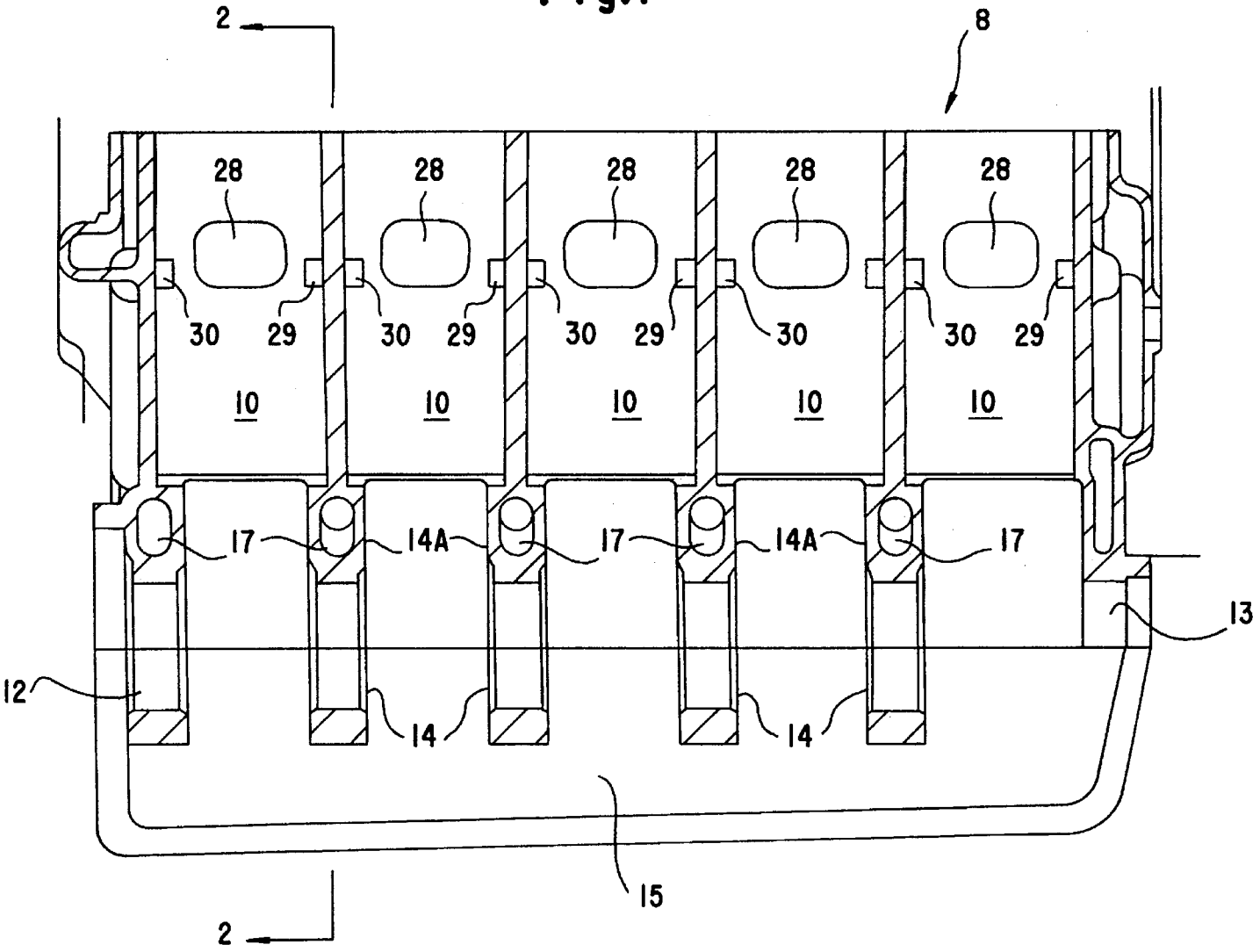
FIG. 1 is a longitudinal sectional view of the engine block of a five cylinder in-line engine.
Figure 2:
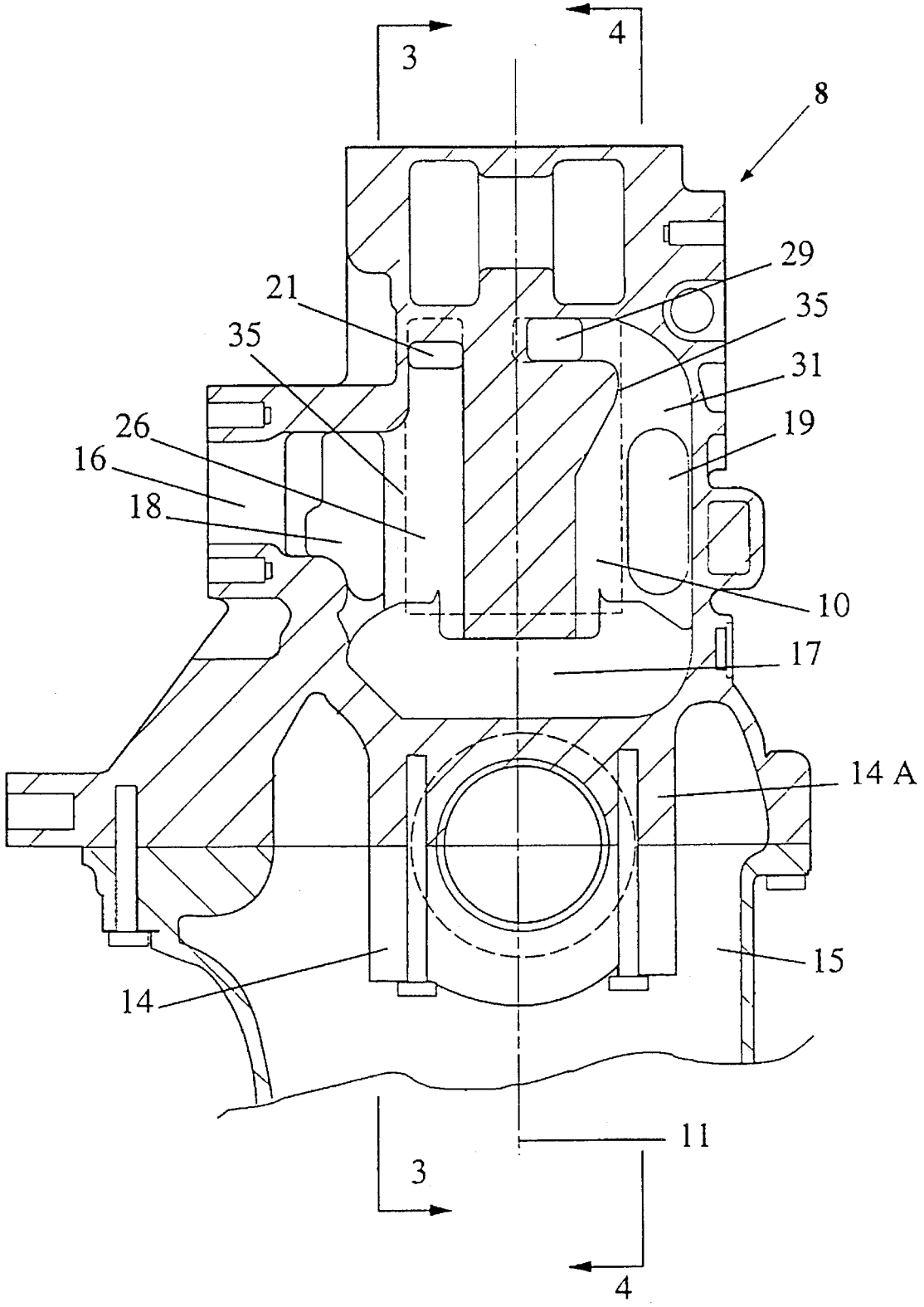
FIG. 2 is a sectional view along line 2—2 in FIG. 1.

Referring now to the drawings, there is illustrated a block 8 and crankcase 15 of a five cylinder in-line two-stroke cycle engine having the cylinders 10 arranged in a formation with the axis of each cylinder located in a common longitudinal plane as indicated by the centre line 11 in FIG. 2. It is to be noted that in the drawings, the cylinder head and the crankshaft of the engine are not shown, however, those skilled in the art would be fully acquainted with the constructions of such components of internal combustion engines and will not require further description in regard to their construction or interaction with the cylinder block 8 and crankcase 15 as illustrated.

The crankcase 15 and cylinder block 8 together provide crankshaft end bearings 12 and 13 and four intermediate crankshaft bearings 14, each of the bearings 12, 13, 14 being split along the axis of the crankshaft so that the lower portions thereof are formed integral with the crankcase 15 and the upper portions thereof integral with the cylinder block 8. This construction of the crankshaft bearings 12, 13, 14 is common in the engine industry. It is also to be noted that the crankcase 15 is constructed in the manner commonly known in engines of the four-stroke cycle type and in two-stroke cycle engines operating on the external scavenged principle, which may incorporate a wet sump.

The intermediate bearings 14 are of a known construction wherein the upper portion thereof is formed integral with the cylinder block 8 and incorporate a bearing support portion 14*a* which extends from the lower end of the cylinders 10 of the cylinder block 8 to the axial centre line of the crankshaft bearings 12,13,14. As the actual bearings supporting the crankshaft must be spaced a distance below the lower end of the cylinders 10 of the engine in order to accommodate the eccentrically located conrod bearings of the crankshaft, there is sufficient space to provide a passage 17 in this upper bearing support portion 14A.

As seen in FIG. 2, one end of the passage 17 communicates directly with the gallery 18 extending longitudinally along the left hand side of the cylinder block 8, and communicates at the opposite end thereof with the gallery 19 extending along the opposite right hand side of the cylinder block 8. Each cylinder 10 is provided with two or more ports on either side of the longitudinal plane 11 with the ports on the left hand side as seen in FIG. 2 communicating with the gallery 18, whilst on the right hand side of the engine the ports communicate with the gallery 19. The gallery 18 communicates with a source of air for use by the engine by way of the inlet 16 which is typically connected to an air inlet means (not shown) of the engine.

Figure 3:
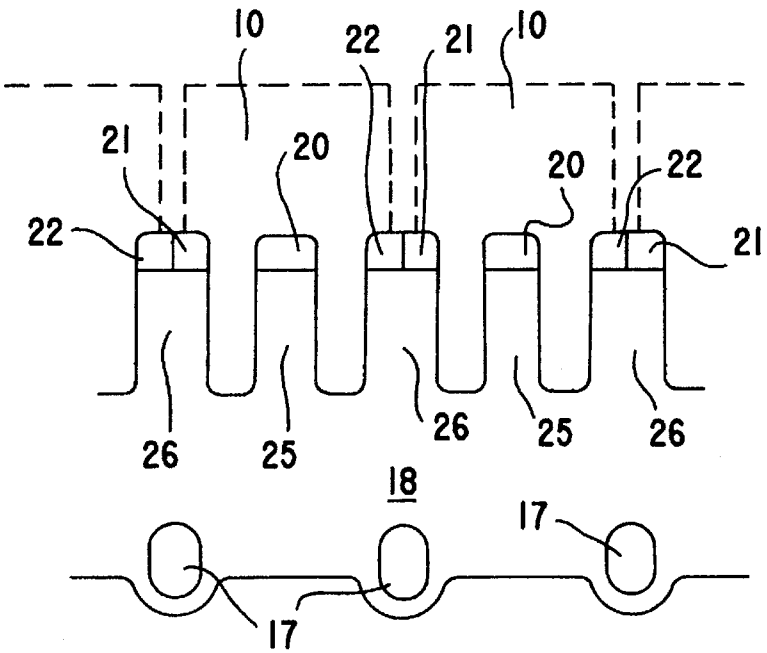
FIG. 3 is a sectional view along line 3—3 in FIG. 2 of a portion of the length of the cylinder block.

Referring now specifically to FIG. 3 of the drawings which depicts the left or inlet side of the engine as shown in FIG. 2, it will be noted that each cylinder 10 is provided with a central transfer port 20 commonly referred to as a "rear port", and to each side thereof respective auxiliary ports 21 and 22. Each of the rear ports 20 communicate with the gallery 18 via respective individual passages 25 while the ports 21 and 22 of each two adjacent cylinders 10 are in communication with the gallery 18 via common passages 26. The ports 21 and 22 which communicate with the common passage 26 are commonly referred to as "siamese ports".

Figure 4:
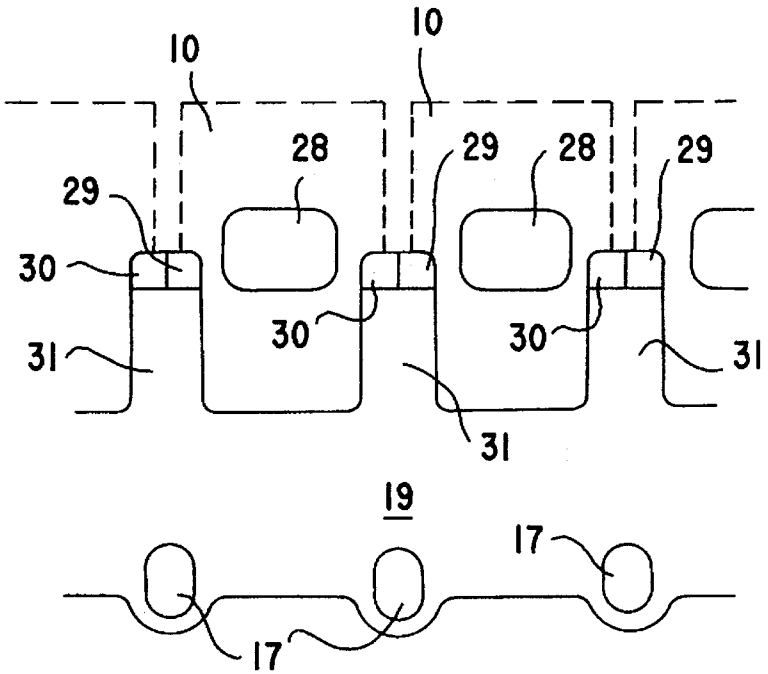
FIG. 4 is a sectional view along line 4—4 in FIG. 2 of a portion of the length of the cylinder block.

On the right side or exhaust side of the engine as shown in FIG. 4, each cylinder 10 is provided with a centrally located exhaust port 28 and to each side thereof an inlet port 29 and 30 respectively. The adjacent ports 29 and 30 of the respective cylinders 10 are connected to common passages 31 to provide communication with the gallery 19. Again, the ports 29 and 30 are in a siamese configuration.

It will be appreciated from a consideration of FIGS. 3 and 4 that the ports 21, 22 & 29, 30 which are arranged in the siamese formation are located in the valley formed between the cylindrical walls of two adjacent cylinders 10 and thus the passages 26 and 31 respectively can be of a substantial depth without significantly increasing the overall physical dimensions of the cylinder block 8 in the direction transverse to the direction of the crankshaft. This feature can be also recognised from a consideration of FIG. 2 of the drawings wherein the cylinder walls are shown in dotted outline at 35 and the passages 26 & 31 extend substantially inwardly from these walls towards the axis of the cylinder 10. This further contributes to the reduction of,the overall transverse dimensions of the engine. Also the galleries 18 and 19 can be arranged to follow the contour of the cylinders 10 on the respective sides of the cylinder block 8 in the longitudinal plane of the cylinder block 8 to thereby contribute to the reduction in overall width of the cylinder block 8.

In the construction described with reference to the drawings, the passage 17 extends through the bearing support portion 14A above the centre-line of the crankshaft, however, it is to be understood that the passage 17 could be arranged to extend downwardly through the bearing support 14 on either side thereof and pass beneath the centre-line of the crankshaft through the bearing support 14.

The present invention has been described in relation to the provision of passages for the supply of incoming air to the transfer ports on both sides of the cylinder. Other applications of the invention are also envisaged. For example, the invention is applicable for the conveying of exhaust gases within or between cylinders for exhaust gas recirculation (EGR) applications. Alternatively or in addition, the invention can facilitate the distribution of coolant around, for example, the exhaust port or around the upper section of the cylinder defining in part the combustion chamber.

We claim:

1. A reciprocating piston internal combustion engine having at least one cylinder, including a conduit means extending through a section of the engine located below the at least one cylinder, the conduit means providing communication between opposite sides of the at least one cylinder and enabling the transfer of gases associated with the combustion process within the at least one cylinder, wherein the conduit means extends through at least one crankshaft bearing support located within a crankcase of the engine.

2. An engine according to claim 1, wherein the engine has at least two cylinders, the conduit means being located below the junction of at least one pair of the adjacent cylinders.

3. An engine according to claim 1, wherein the at least one cylinder has at least one port on one side thereof, the conduit means providing communication between each port and an opposite side or each cylinder.

4. An engine according to claim 3, wherein the conduit means provides communication between the at least one port located on one side of the at least one cylinder, and an opposing at least one port located at an opposite side of each cylinder.

5. An engine according to claim 3, wherein the gas is air, and the at least one port is an inlet port for supplying air to the at least one cylinder.

6. An engine according to claim 3, wherein the conduit means is arranged to communicate with ports in two adjacent cylinders.

7. An engine according to claim 6, wherein the ports in two adjacent cylinders are arranged so that only one is open at any one time.

8. An engine according to claim 4, wherein the engine is externally scavenged, the at least one port on one side of the at least cylinder communicates with a first common gallery, the at least one port on the opposing side of the at least one cylinder communicates with a second common gallery, the conduit means extending between said common galleries to provide communication therebetween.

9. An engine according to claim 1, including a cylinder block having a plurality of cylinders and providing a respective portion of said at least one crankshaft bearing support, the at least one bearing support portion being located below the junction of each of the adjacent cylinders, with a part of said conduit means extending through the at least one said bearing support portion.

10. An engine according to claim 1, wherein the conduit means extends through a crankshaft bearing support portion above a crankshaft supported by the bearing support.

11. An engine according to claim 1, wherein the engine is a two stroke engine.

* * * * *